US011507120B2

(12) United States Patent
Shreepathi Bhat

(10) Patent No.: US 11,507,120 B2
(45) Date of Patent: Nov. 22, 2022

(54) LOAD CURRENT BASED DROPOUT CONTROL FOR CONTINUOUS REGULATION IN LINEAR REGULATORS

(71) Applicant: Texas Instruments Incorporated, Dallas, TX (US)

(72) Inventor: Avinash Shreepathi Bhat, Tucson, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/016,840

(22) Filed: Sep. 10, 2020

(65) Prior Publication Data

US 2021/0080985 A1 Mar. 18, 2021

Related U.S. Application Data

(60) Provisional application No. 62/900,223, filed on Sep. 13, 2019.

(51) Int. Cl.
*G05F 1/575* (2006.01)
*G05F 1/565* (2006.01)

(52) U.S. Cl.
CPC ..... *G05F 1/565* (2013.01); *G05F 1/575* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 10,571,942 B2 * 2/2020 Tomioka ..... G05F 1/575
2020/0278710 A1 9/2020 Sankman

OTHER PUBLICATIONS

Chester Simpson; "Linear and Switching Voltage Regulator Fundamentals" Texas Instruments; 2011; Dallas, Texas; Literature No. SNVA558.
Michael Day; "Understanding Low Drop Out (LDO) Regulators"; Texas Instruments Portable Power Design Seminar; 2006; Topic 9; Literature No. SLUP239A.

(Continued)

*Primary Examiner* — Thienvu V Tran
*Assistant Examiner* — Nusrat Quddus
(74) *Attorney, Agent, or Firm* — Charles A. Brill; Frank D. Cimino

(57) ABSTRACT

In a linear regulator system, a pass element has a control terminal, an input terminal and an output terminal. The pass element is configured to provide an output voltage at the output terminal based on: an input voltage at the input terminal; and a control signal at the control terminal. A dropout error amplifier has an error output and first and second inputs. The first input is coupled to the output terminal, and the error output is coupled to the control terminal. The dropout error amplifier is configured to provide a dropout control signal at the error output based on a comparison between: the output voltage at the first input; and a dropout reference voltage at the second input. The pass element is configured to regulate the output voltage at the dropout reference voltage, responsive to the dropout control signal.

23 Claims, 5 Drawing Sheets

(56) References Cited

OTHER PUBLICATIONS

Sajjad Hajdar; "Current Limiter Offers Circuit Protection with Low Voltage Drop"; Electronic Design; Apr. 18, 2016; https://www.electronicdesign.com/power-management/article/21801456/current-limiter-offers-circuit-protection-with-low-voltage-drop.
Wikipedia; "Voltage Regulator" Last Edited: Jun. 16, 2020; https://en.wikipedia.org/wiki/Voltage_regulator#:~:text=A%20voltage%20regulator%20is%20a,electromechanical%20mechanism%2C%20or%20electronic%20components.
Jameco Electronics; "Electronics Fundamentals: Voltage Regulator" https://www.jameco.com/Jameco/workshop/learning-center/voltage-regulator.html.
Brendan Whelan et al.; "Finally, High Voltage Current Sensing Made Easy"; Linear Technology; vol. XV, No. 2; May 2005.
Digikey; "How to Select and Apply Smart Current Sensing and Monitoring Technologies (Instead of Fuses)"; Digi-Key North American Editors; Oct. 6, 2016 https://www.digikey.com/en/articles/how-to-select-smart-current-sensing-monitoring-technologies.
Analog Devices "Understanding How a Voltage Regulator Works"; 2009 Analog Devices, Inc. https://www.analog.com/media/en/technical-documentation/tech-articles/Understanding-How-a-Voltage-Regulator-Works.pdf.
"Understanding Linear Regulators and Their Key Performance Parameters," Apr. 10, 2016 by Intersil Corporation.

* cited by examiner

LOAD CURRENT BASED DROPOUT CONTROL FOR CONTINUOUS REGULATION IN LINEAR REGULATORS

CROSS-REFERENCE TO RELATED APPLICATION

This application claims the benefit of U.S. Provisional Patent Application No. 62/900,223 filed Sep. 13, 2019, which is hereby incorporated herein by reference in its entirety.

TECHNICAL FIELD

This description relates to linear regulators, and more particularly to systems and methods for load current based dropout control for continuous regulation in linear regulators.

BACKGROUND

Electronic circuits are powered by a supply voltage, such as a constant supply voltage. To provide that constant DC output voltage, a linear regulator has circuitry that continuously holds the output voltage at a specified value regardless of changes in load current or supply voltage. For example, the linear regulator provides a regulated output voltage for varying supply voltage and load current, so long as the load current and the supply voltage are within a specified operating range for the linear regulator.

SUMMARY

Figure 1:
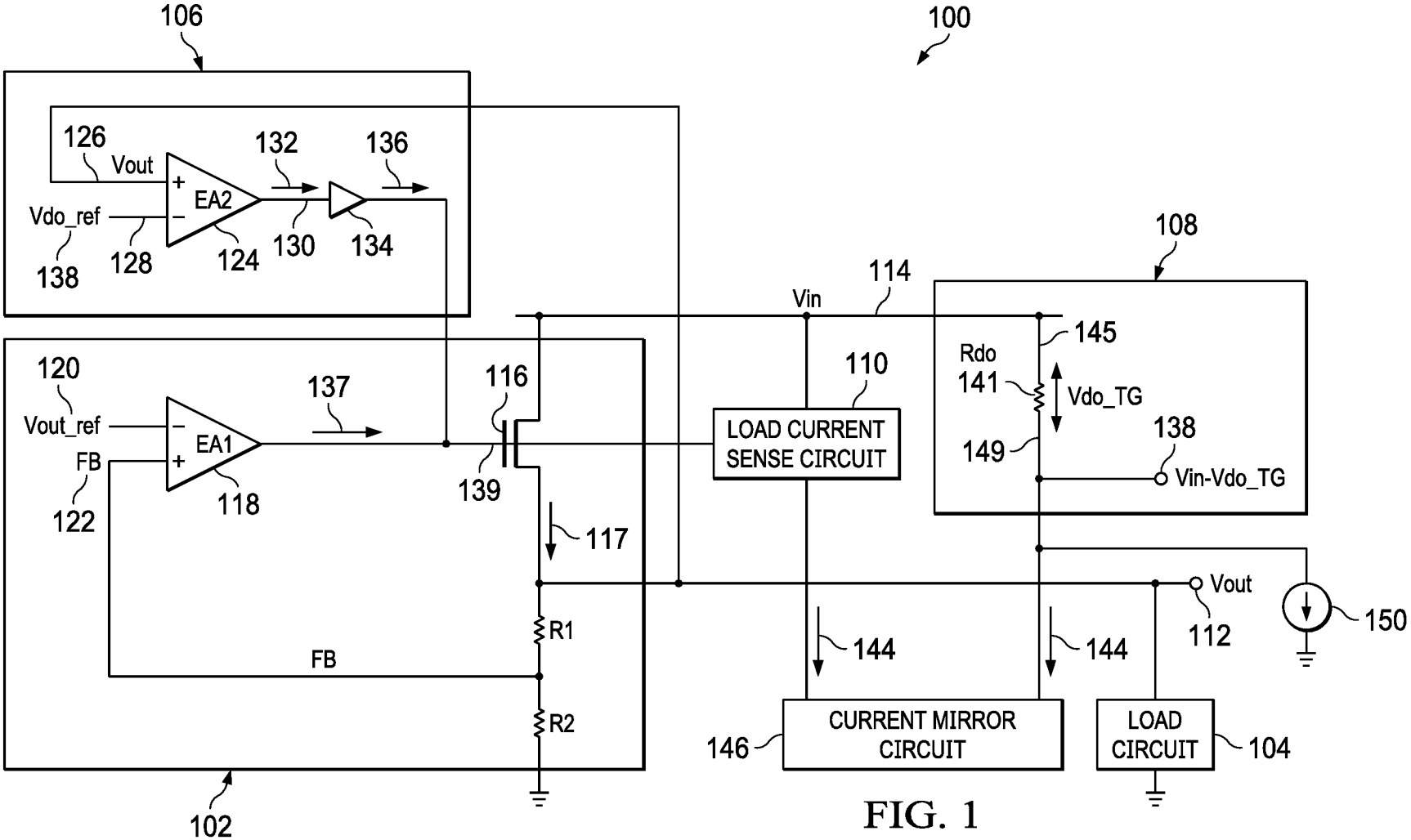
FIG. 1 is a block diagram of a linear regulator system, according to one aspect of this description.

In a linear regulator system, a pass element has a control terminal, an input terminal and an output terminal. The pass element is configured to provide an output voltage at the output terminal based on: an input voltage at the input terminal; and a control signal at the control terminal. A dropout error amplifier has an error output and first and second inputs. The first input is coupled to the output terminal, and the error output is coupled to the control terminal. The dropout error amplifier is configured to provide a dropout control signal at the error output based on a comparison between: the output voltage at the first input; and a dropout reference voltage at the second input. The pass element is configured to regulate the output voltage at the dropout reference voltage, responsive to the dropout control signal.

DETAILED DESCRIPTION

The drawings may not be drawn to scale. This description is not limited by the illustrated ordering of acts or events, as some acts may occur in different orders and/or concurrently with other acts or events. Also, some illustrated acts or events are optional to implement a methodology in accordance with this description.

As described above, linear regulators provide a regulated output voltage for varying supply voltage and load current, so long as the load current and the supply voltage are within a specified operating range for the linear regulator. The linear regulators may be referred to as linear voltage regulators or voltage regulators, in other aspects. Example linear regulators include a pass element, which includes a semiconductor switch element configured to provide an output voltage to a load circuit associated therewith.

The pass element is configured to provide the output voltage based on an input voltage (or supply voltage). In some aspects, a resistance of the pass element is controlled to regulate the output voltage of the linear regulator, and to thereby form a regulated output voltage. For example, the linear regulators include a voltage feedback loop, which includes a voltage error amplifier circuit that compares the output voltage to an output reference voltage, in order to regulate the output voltage to form the regulated output voltage. The regulated output voltage is less than the input voltage.

Often, pass elements have an inherent dropout voltage. In some aspects, the inherent dropout voltage is a minimum voltage to be maintained across the pass element, if the output voltage is to be regulated (i.e., to maintain the output voltage at a particular level). Accordingly, the input voltage must be higher than the regulated output voltage by at least the inherent dropout voltage.

In some aspects, the input voltage (or the supply voltage) may vary due to various circuit conditions. If the input voltage decreases to a level that is very near the regulated output voltage, then the output voltage varies from the regulated output voltage to maintain the inherent dropout voltage across the pass element, thereby entering a dropout condition. In such aspects, the loop regulation of the voltage feedback loop is lost (such as by the output voltage falling below the regulated output voltage). If the output voltage is not regulated during the dropout condition, then a large output voltage overshoot may occur when the input voltage returns to high while exiting the dropout condition. In some aspects, a current consumption of the linear regulator also increases during the dropout condition. Therefore, maintaining regulation during the dropout condition is important.

To maintain a regulated output voltage during the dropout condition, a linear regulator herein includes a dropout control circuit, which regulates the output voltage to form a dropout condition output voltage. During the dropout condition, the dropout condition output voltage keeps a voltage across the pass element equal to a target dropout voltage. In some aspects, the target dropout voltage is a particular minimum dropout voltage to be maintained across the pass element, in order to maintain regulation of the output voltage. In some aspects, the target dropout voltage is selected to be greater than the inherent dropout voltage of the pass element.

In the linear regulators, the inherent dropout voltage may vary with the load current. Accordingly, when the load current through the pass element is lower, the inherent dropout voltage is lower. When the load current through the pass element is higher, the inherent dropout voltage is higher. Therefore, the target dropout voltage to be maintained across the pass element may be different, depending on the load current through the pass element.

Accordingly, when the load current is lower, a lower target dropout voltage should be maintained across the pass element, relative to a target dropout voltage to be maintained across the pass element when the load current is higher. To account for the variation of the target dropout voltage with the load current, the target dropout voltage is derived as a function of the load current that passes through the pass element, in some example embodiments. In at least one example, the dropout control circuit is configured to regulate the output voltage to form a dropout condition output voltage, which limits the voltage across the pass element to be equal to the target dropout voltage.

In another aspect, the dropout control circuit is configured to regulate the output voltage to form a dropout condition output voltage, which limits the voltage across the pass element to be equal to the target dropout voltage. The target dropout voltage is derived as a function of the load current and a temperature of the linear regulator circuit.

In yet another aspect, the dropout control circuit is configured to regulate the output voltage to form the dropout condition output voltage, which limits the voltage across the pass element to be equal to the target dropout voltage. The target dropout voltage is derived as a function of the load current, and the target dropout voltage is increased when an input voltage of the linear regulator falls below a particular supply voltage threshold.

In some aspects, example embodiments reduce power loss, as the target dropout voltage (to be maintained across the pass element) is varied with the varying load current and/or temperature. Further, in some example embodiments, only one of a voltage feedback loop (which regulates the output voltage to the regulated output voltage) or a dropout feedback loop (which regulates the output voltage to the dropout condition output voltage) is regulating the output voltage at any instant, thereby avoiding stability issues that could otherwise occur in multi-loop regulation.

FIG. 1 illustrates a simplified block diagram of a linear regulator system 100, according to one aspect of this description. In some aspects, the linear regulator system 100 is configured to provide a regulated output voltage to load circuits coupled therewith. The linear regulator system 100 includes a linear regulator core circuit 102 configured to provide an output voltage Vout 112 based on an input voltage Vin 114. In some aspects, the input voltage Vin 114 may be provided from an input supply source (not shown) associated therewith. In some aspects, the linear regulator core circuit 102 is configured to provide the output voltage Vout 112 to a load circuit 104 associated therewith. The linear regulator core circuit 102 includes a pass element 116 configured to provide the output voltage Vout 112 based on the input voltage Vin 114. The pass element 116 has an input terminal to receive the input voltage Vin 114 and an output terminal to provide the output voltage Vout 112. In some aspects, the pass element 116 includes a power semiconductor switch element, such as metal oxide semiconductor field effect transistors (MOSFETs), bipolar junction transistors (BJTs) etc. In alternative implementations, the pass element 116 may include a combination of one or more power semiconductor switch elements. The linear regulator core circuit 102 includes a voltage error amplifier circuit 118 coupled to the pass element 116 and configured to regulate the output voltage Vout 112 to form a regulated output voltage $V_{REG}$. A value of the regulated output voltage $V_{REG}$ is preselected.

The voltage error amplifier circuit 118 is configured to regulate the output voltage Vout 112 through negative feedback to form the regulated output voltage $V_{REG}$, based on comparing a feedback voltage FB 122 derived based on the Vout 112 to an output reference voltage Vout_ref 120. For example, the voltage error amplifier circuit 118 generates a voltage error signal 137 based on the difference between FB 122 and Vout_ref 120, to be provided to a control terminal 139 of the pass element 116. In some aspects, the control terminal 139 corresponds to a gate terminal (in case of MOSFETs) or a base terminal (in case of BJTs). In some aspects, the voltage error signal 137 modulates a resistance of the pass element 116 to ensure that FB 122 and Vout_ref 120 (at the input terminals of the voltage error amplifier circuit 118) are equal, thereby regulating the Vout 112 to form the regulated output voltage $V_{REG}$.

In some aspects, a value of the Vout_ref 120 is selected to ensure that Vout 112 is regulated to form the regulated output voltage $V_{REG}$, when FB 122 and Vout_ref 120 at the input terminals of the voltage error amplifier circuit 118 are equal. The FB 122 is indicative of the Vout 112. In some aspects, FB 122 is same as the Vout 112. In alternative implementations, the FB 122 may be different from the Vout 112. For example, in some aspects, the FB 122 may be derived from Vout 112 using a voltage divider arrangement including R1 and R2 as shown in FIG. 1.

Often, the pass element 116 has an inherent dropout voltage. In some aspects, the inherent dropout voltage is a minimum voltage to be maintained across the pass element 116, if the output voltage Vout 112 is to be regulated (i.e., to maintain the regulation of the output voltage). Also, in some aspects, the inherent dropout voltage is contributed by a minimum inherent resistance of the pass element 116. Further, in some aspects, the input voltage Vin 114 may vary due to various circuit conditions or environmental conditions.

If the input voltage Vin 114 decreases to a level that is very near the regulated output voltage $V_{REG}$, then the voltage across the pass element 116 tries to fall below the inherent dropout voltage. In such aspects, the output voltage Vout 112 varies from the regulated output voltage $V_{REG}$ to maintain the inherent dropout voltage, thereby entering a dropout condition. During the dropout condition, because the output voltage Vout 112 varies from the regulated output voltage $V_{REG}$, the voltage regulation (by the voltage error amplifier circuit 118) of the output voltage Vout 112 is lost.

As described above, if the output voltage Vout 112 is not regulated during the dropout condition, then a large output voltage overshoot may occur when the input voltage Vin 114 returns high while exiting the dropout condition (i.e., when the Vin 114 is high enough to maintain the regulated output voltage $V_{REG}$). Accordingly, the output voltage Vout 112 overshoots to a high value before settling to the regulated output voltage $V_{REG}$. This may lead to the damage of load circuits 104 (e.g., microcontrollers) coupled to the linear regulator system 100. Therefore, keeping the output voltage Vout 112 regulated is important, irrespective of the changes in the input voltage Vin 114.

To maintain the output voltage regulation with the varying input voltage Vin 114 (specifically during the dropout condition), the linear regulator system 100 includes a dropout control circuit 106 coupled to the control terminal 139 of the pass element 116. The dropout control circuit 106 includes a dropout error amplifier circuit 124 and a dropout driver circuit 134. In some aspects, the dropout error amplifier circuit 124 is configured to regulate the output voltage Vout 112 of the pass element 116 to a dropout condition output voltage $V_{D_OUT}$, which keeps the voltage across the pass element 116 equal to a target reference voltage Vdo_TG, based on negative feedback, when the input voltage Vin 114 is too low to maintain the regulated output voltage $V_{REG}$. In some aspects, the target dropout voltage Vdo_TG includes a particular minimum dropout voltage to be maintained across the pass element 116, in order to maintain regulation of the output voltage Vout 112. In some aspects, the target dropout voltage Vdo_TG is selected to be greater than the inherent dropout voltage of the pass element 116. In some aspects, the dropout error amplifier circuit 124 is configured to regulate the output voltage Vout 112 of the pass element 116 to the dropout condition output voltage $V_{DO_OUT}$, based on a dropout reference voltage Vdo_ref 138 that is derived in terms of the target dropout voltage Vdo_TG.

For example, the dropout error amplifier circuit 124 includes: a first input terminal 126 configured to receive the output voltage Vout 112; and a second input terminal 128 configured to receive the dropout reference voltage Vdo_ref 138 including a difference between the input voltage Vin 114 and the target dropout voltage Vdo_TG of the pass element 116. The dropout error amplifier circuit 124 includes an output terminal (or an error output terminal) 130 configured to provide a dropout control signal 132 that is generated based on a comparison between the output voltage Vout 112 and the dropout reference voltage Vdo_ref 138. In some aspects, the dropout error amplifier circuit 124 is configured to regulate the output voltage Vout 112 of the pass element 116 to the dropout condition output voltage $V_{DO_OUT}$, based on the dropout control signal 132. In some aspects, the dropout control signal 132 regulates the output voltage Vout 112 of the pass element 116 to the dropout condition output voltage $V_{DO_OUT}$, based on modulating a resistance of the pass element 112.

The dropout control signal 132 regulates the output voltage Vout 112 of the pass element 116 to the dropout condition output voltage $V_{DO_OUT}$, when the dropout reference voltage Vdo_ref 138 at the second input terminal 128 of the dropout error amplifier circuit 124 becomes less than the output voltage Vout 112 at the first input terminal 126 of the dropout error amplifier circuit 124, in order to operate the linear regulator core circuit 102 in a dropout operation mode in which the output voltage Vout 112 is maintained/regulated at the dropout condition output voltage $V_{DO_OUT}$. In some aspects, the dropout reference voltage Vdo_ref 138 at the second input terminal 128 of the dropout error amplifier circuit 124 becomes less than the output voltage Vout 112, when Vin 114 becomes very near Vout 112, so the difference between Vin 114 and Vout 112 is less than the target dropout voltage Vdo_TG of the pass element 116. Therefore, in such aspects, the Vout 112 is regulated by the dropout control signal 132 to form the dropout condition output voltage $V_{DO_OUT}$, so the difference between the $V_{DO_OUT}$ and Vin 114 is kept equal to the target dropout voltage Vdo_TG. Accordingly, the Vout 112 is regulated by the dropout control signal 132 to form the dropout condition output voltage $V_{DO_OUT}$, so the output voltage Vout 112 (i.e., the dropout condition output voltage $V_{DO_OUT}$) at the first input terminal 126 of the dropout error amplifier circuit 124 becomes equal to the dropout reference voltage Vdo_ref 138 at the second input terminal 128 of the dropout error amplifier circuit 124. Therefore, the dropout condition output voltage $V_{DO_OUT}$ is equal to the dropout reference voltage Vdo_ref 138. In some aspects, the dropout condition output voltage $V_{DO_OUT}$ is less than the regulated output voltage $V_{REG}$. Therefore, in such embodiments, the dropout control signal 132 enables the system 100 to keep the output voltage Vout 112 regulated at the dropout condition output voltage $V_{DO_OUT}$, when the Vin 114 is too low to maintain the output voltage Vout 112 at the regulated output voltage $V_{REG}$.

In some aspects, the dropout control signal 132 regulates the output voltage Vout 112 of the pass element 116 to the dropout condition output voltage $V_{DO_OUT}$ until the dropout reference voltage Vdo_ref 138 at the second input terminal 128 of the dropout error amplifier circuit 124 becomes greater than the regulated output voltage $V_{REG}$. In some aspects, the voltage error amplifier circuit 118 is configured to regulate the output voltage Vout 112 to the regulated output voltage $V_{REG}$ when the dropout reference voltage Vdo_ref 138 at the second input terminal 128 of the dropout error amplifier circuit 124 becomes equal to or greater than the regulated output voltage $V_{REG}$. For example, the voltage error amplifier circuit 118 is configured to regulate the output voltage Vout 112 to the regulated output voltage $V_{REG}$, during a regular operation mode of the linear regulator circuit in which the Vin 114 is greater than $V_{REG}$ at least by the target dropout voltage Vdo_TG. Consequently, during the regular operation mode, the dropout reference voltage Vdo_ref 138 (i.e., the difference between the Vin 114 and the target dropout voltage Vdo_TG as defined above) at the second input terminal 128 of the dropout error amplifier circuit 124 is greater than or equal to the output voltage Vout 112 (including the regulated output voltage $V_{REG}$) at the first input terminal 126 of the dropout error amplifier circuit 124. Therefore, during the regular operation mode, the dropout control signal 132 does not regulate the output voltage Vout 112 of the pass element 116 to the dropout condition output voltage $V_{DO_OUT}$. In one example, the target dropout voltage Vdo_TG of the pass element 116 is equal to 0.5 V. During regular operation mode, Vout=$V_{REG}$=3V, and Vin=6V, so Vdo_ref=Vin−Vdo_TG=5.5 V, which is greater than Vout. However, if the Vin is reduced to 3.4V, then Vdo_ref becomes 2.9V (which is less than Vout), and the dropout control signal 138 regulates Vout to form $V_{DO_OUT}$=2.9V, in order to maintain the target dropout voltage Vdo_TG=0.5V across the pass element.

In some aspects, the output terminal 130 of the dropout error amplifier circuit 124 is coupled to the control terminal 139 of the pass element 116, in order to modulate the resistance of the pass element 116 (in turn to regulate the output voltage Vout 112 of the pass element 116). For example, the dropout error amplifier circuit 124 is configured to modulate the resistance of the pass element 116 based on controlling a voltage at the control terminal 139 of the pass element 116. In some aspects, the dropout error amplifier circuit 124 is coupled to the control terminal 139 of the pass element 116 via the dropout driver circuit 134. In some aspects, the dropout error amplifier circuit 124 is configured to provide the dropout control signal 132 to the dropout driver circuit 134, in order to regulate the output voltage Vout 112 of the pass element 116 to the dropout condition output voltage $V_{DO_OUT}$ In some aspects, the dropout driver circuit 134 is coupled between the output terminal 130 of the dropout error amplifier circuit 124 and the control terminal 139 of the pass element 116. For example, the dropout control signal 132 controls the dropout driver circuit 134 to generate a dropout driver signal 136 that modulates a resistance of the pass element 116, in order to regulate the output voltage Vout 116 of the pass element to the dropout condition output voltage $V_{DO_OUT}$, during the dropout operation mode. In some aspects, dropout driver signal 136 includes a signal having appropriate voltage and current to drive the control terminal of the pass element 116.

During the dropout operation mode, the dropout driver signal 136 overrides the voltage error signal 137 from the voltage error amplifier circuit 118, in order to modulate a resistance of the pass element 116. In some aspects, the dropout driver circuit 134 may include a power semiconductor switch element, such as a p-channel field effect transistor (PFET), an n-channel field effect transistor (NFET), a bipolar junction transistor (BJT) etc. In alternative implementations, the dropout driver circuit 134 may be implemented differently. In some aspects, a size/rating of dropout driver circuit 134 is selected to ensure that the dropout driver signal 136 overrides the voltage error signal 137 from the voltage error amplifier circuit 118. Further, during the regular operation mode, the dropout driver signal 136 (generated by the dropout driver circuit 134, based on the dropout control signal 132) may be negligible or zero, thereby not overriding the voltage error signal 137 from the voltage error amplifier circuit 118. In alternative implementations, the dropout control signal 132 may control the control terminal 139 of the pass element 116 directly without using the dropout driver circuit 134.

Therefore, in some aspects, the dropout error amplifier circuit 124 ensures that the output voltage 112 is regulated, when the output voltage 112 is reduced from the regulated output voltage $V_{REG}$ due to a reduction in the input voltage Vin 114. In this embodiment, the output voltage Vout 112 is provided to the positive terminal of the dropout error amplifier circuit 124, and the dropout reference voltage Vdo_ref 138 is provided to the negative terminal of the dropout error amplifier circuit 124. However, the connections associated with the dropout error amplifier circuit 124 are for illustrative purpose only and do not limit this particular implementation. Depending on the type of the dropout driver circuit 134 and/or the pass element 116, the terminals may be inverted, in different embodiments, to achieve the required value of the dropout control signal 132 and negative feedback.

In linear regulators, the inherent dropout voltage may vary with the load current 117. Accordingly, when the load current 117 through the pass element 116 is lower, the inherent dropout voltage of the pass element 116 is lower. And when the load current 117 through the pass element 116 is higher, the inherent dropout voltage of the pass element 116 is higher. To account for the variation of the inherent dropout voltage with respect to the load current 117, in this aspect, the target dropout voltage Vdo_TG to be maintained across the pass element 116 is derived as a function of a load current 117 through the pass element 116. Accordingly, the target dropout voltage Vdo_TG is modulated/varied with a variation in the load current 117. In some aspects, varying the target dropout voltage Vdo_TG with the load current 117 enables a reduction in power consumption of the linear regulator core circuit 102. For example, when the load current 117 through the pass element 116 is lower, a lower target voltage Vdo_TG should be maintained across the pass element 116, relative to a target dropout voltage Vdo_TG to be maintained across the pass element 116 when the load current 117 is higher. To account for the variation of the Vdo_TG, the linear regulator system 100 includes a dropout reference voltage generator circuit 108 configured to generate the dropout reference voltage Vdo_ref 138 including a difference between the input voltage Vin 114 and the target dropout voltage Vdo_TG of the pass element 116. In some aspects, the target dropout voltage Vdo_TG of the pass element 116 is derived within the dropout reference voltage generator circuit 108 as a function of the load current 117.

For example, the dropout reference voltage generator circuit 108 includes a dropout resistance element Rdo 141 configured to have a voltage drop corresponding to the target dropout voltage Vdo_TG of the pass element 116 when a sense current 144 indicative of the load current 117 passes through the dropout resistance element Rdo 141. In some aspects, the sense current 144 includes a fraction of the load current 117. For example, in some aspects, a value of the Rdo 141 may be determined based on determining the target dropout voltage Vdo_TG of the pass element 116 for a maximum value of the load current 117 and identifying a selected resistance value that achieves a voltage drop corresponding to the target dropout voltage Vdo_TG, when a sense current 144 corresponding to the maximum load current 117 flows through the selected resistance value. The dropout resistance element Rdo 141 includes: a first terminal 145 coupled to the input voltage 114; and a second terminal 149 configured to provide the dropout reference voltage Vdo_ref 138 including a difference between the Vin 114 and the Vdo_TG.

The linear regulator system 100 includes a load current sense circuit 110 configured to generate the sense current 144 based on the load current 117. In some aspects, the inherent dropout voltage of the pass element 116 varies further with a temperature of the linear regulator system 100. Accordingly, when the temperature is lower, the inherent dropout voltage is lower. And when the temperature is higher, the inherent dropout voltage is higher. To account for the variation of the inherent dropout voltage with temperature, in this aspect, the target dropout voltage Vdo_TG to be maintained across the pass element 116 is further derived as a function of the temperature of the linear regulator system 100. To achieve this feature, the sense current 144 that flows through the dropout resistance element Rdo 141 is derived as a function of a temperature of the linear regulator system 100. For example, for the same load current 117, the sense current 144 will be higher when the temperature is higher, relative to the sense current 144 when the temperature is lower. In some aspects, deriving the target dropout voltage Vdo_TG as a function of temperature enables a reduction in power consumption of the linear regulator system 100 at low temperature conditions. In some aspects, the load current sense circuit 110 may include a sense switch element coupled to the pass element 117 and configured to generate the sense current 144 indicative of the load current 117. In other aspects, the load current sense circuit 110 may include a sense switch element and a temperature dependent switch element coupled to the sense switch element, and configured to generate the sense current 144. Further details are described in embodiments below. In such aspects, the sense current 114 is derived as a function of the temperature of the linear regulator system 100.

Also, in some aspects, the linear regulator system 100 includes a current mirror circuit 146 configured to mirror the sense current 144 from the load current sense circuit 110 and configured to provide/mirror the sense current 144 to the dropout reference voltage generator circuit 108. In other aspects, however, the load current sense circuit 110 may be configured to provide the sense current 144 directly to the dropout reference voltage generator circuit 108 without using the current mirror circuit 146. In some aspects, the linear regulator system 100 includes a dropout current source 150 coupled to the dropout reference voltage generator circuit 108 and configured to provide a small current to the dropout reference voltage generator circuit 108, in order to maintain a minimum current through the dropout resistance element Rdo 141, when the sense current 144 is zero. In some aspects, the small current includes a proportional to absolute temperature (PTAT) current. In some aspects, the dropout current source 150 ensures that the dropout reference voltage Vdo_ref 138 is not zero, even when the load circuit 104 is disconnected.

In some aspects, for a given load current, when the Vin 114 reduces below a particular supply voltage threshold, a gate source voltage ($V_{GS}$) of the pass element 116 decreases. In such aspects, the inherent dropout voltage of the pass element 116 increases. To account for the variation of the inherent dropout voltage with the Vin 114, in this aspect, the target dropout voltage Vdo_TG to be maintained across the pass element 116 is increased when the Vin 114 becomes less than the particular supply voltage threshold. To achieve this feature, the linear regulator system 100 may include a current steering circuit (not shown) coupled between the load current sense circuit 110 and the dropout reference voltage generator circuit 108, further details of which are described in an embodiment below.

Figure 2A:
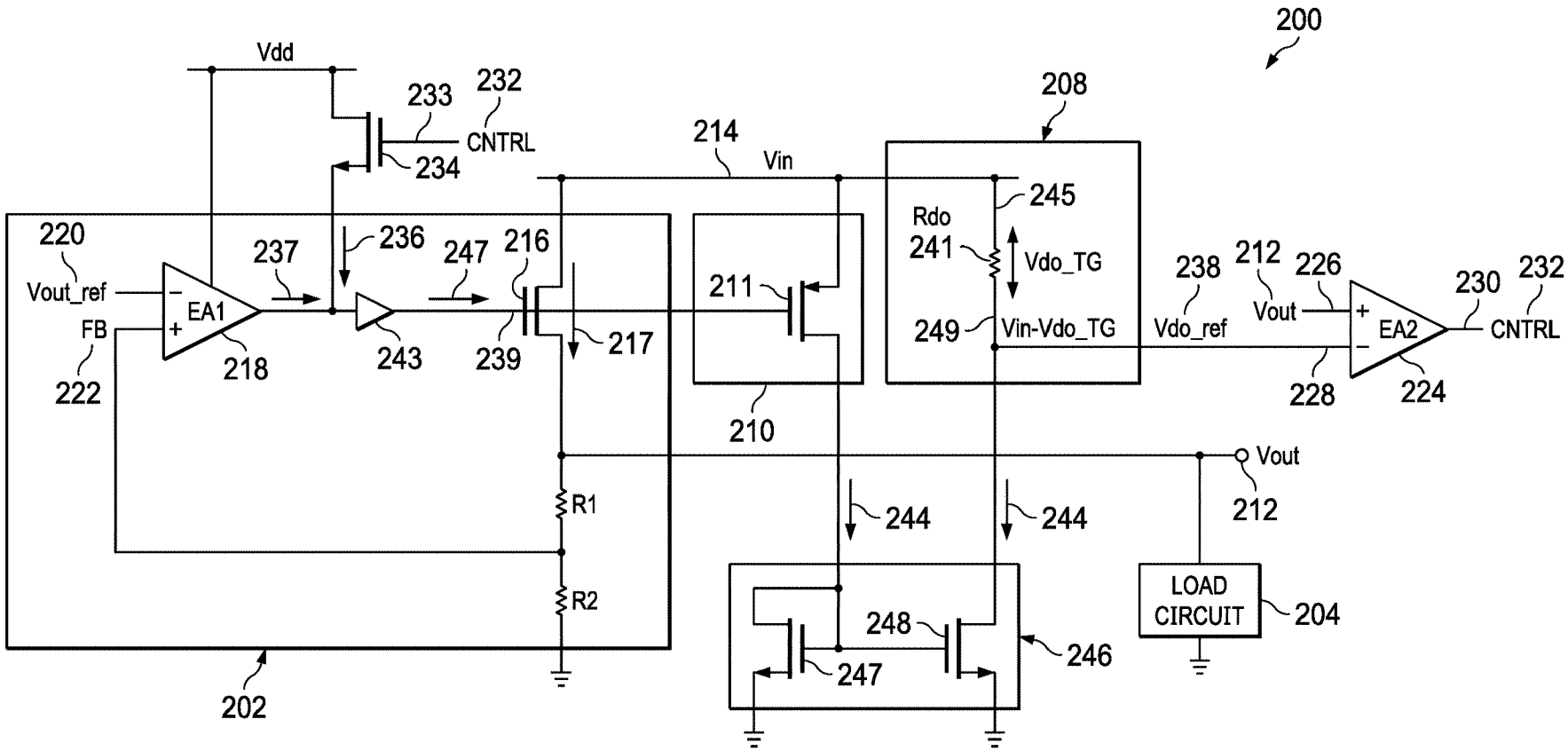
FIG. 2*a* illustrates an example implementation of a linear regulator system, according to one aspect of this description.

FIG. 2*a* illustrates an example implementation of a linear regulator system 200, according to one aspect of this description. In some aspects, the linear regulator system 200 includes one possible way of implementing the linear regulator system 100 in FIG. 1. Therefore, all the features described above with respect to the linear regulator system 100 in FIG. 1 are also applicable to the linear regulator system 200 in FIG. 2*a*. In some aspects, the linear regulator system 200 is configured to provide a regulated output voltage to load circuits coupled therewith. The linear regulator system 200 includes a linear regulator core circuit 202 configured to provide an output voltage Vout 212 based on an input voltage Vin 214. In some aspects, the input voltage Vin 214 may be provided from an input supply source (not shown) associated therewith. In some aspects, the linear regulator core circuit 202 is configured to provide the output voltage Vout 212 to a load circuit 204 associated therewith. In some aspects, the load circuit 204 may include a resistive load, a capacitive load or a combination thereof. The linear regulator core circuit 202 includes a pass element 216 configured to provide the output voltage Vout 212 based on the input voltage Vin 214. In this aspect, the pass element 216 includes a PFET. In alternative implementations, the pass element 216 may include other power semiconductor switch elements, such as NFETs, BJTs etc. Further, in other aspects, the pass element 216 may include a combination of one or more power semiconductor switch elements.

The linear regulator core circuit 202 includes a voltage error amplifier circuit 218 coupled to the pass element 216 and configured to regulate the output voltage Vout 212 to form a regulated output voltage $V_{REG}$. The voltage error amplifier circuit 218 is configured to regulate the output voltage Vout 212 through negative feedback, to form the regulated output voltage $V_{REG}$, based on comparing a feedback voltage FB 222 derived based on the Vout 212 to an output reference voltage Vout_ref 220. For example, the voltage error amplifier circuit 218 generates a voltage error signal 237 based on the difference between FB 222 and Vout_ref 220, to be provided to a control terminal 239 of the pass element 216. In this aspect, the control terminal 239 corresponds to a gate terminal of the PFET 216. The linear regulator core circuit 202 includes a gate driver/buffer circuit 243 coupled to the voltage error amplifier circuit 218 and configured to provide a gate driver signal 247 (generated based on the voltage error signal 237) to the gate terminal 239 of the PFET 216. In some aspects, the gate driver signal 247 includes a high power/current version of the voltage error signal 237. In alternative implementations, the linear regulator core circuit 202 does not include the gate driver/buffer circuit 243.

In some aspects, the voltage error signal 237/the gate driver signal 247 modulates a resistance of the pass element 216 to ensure that FB 222 and Vout_ref 220 at the input terminals of the voltage error amplifier circuit 218 are equal, thereby regulating the Vout 212 to form the regulated output voltage $V_{REG}$. In some aspects, a value of the Vout_ref 220 is selected to ensure that, when FB 222 and Vout_ref 220 at the input terminals of the voltage error amplifier circuit 218 are equal, Vout 212 is regulated to form the regulated output voltage $V_{REG}$. The FB 222 is indicative of the Vout 212. In some aspects, the FB 222 is same as the Vout 212. In alternative implementations, the FB 222 may be different from the Vout 212. For example, in some aspects, the FB 222 may be derived from Vout 212 using a voltage divider arrangement including R1 and R2 as shown in FIG. 1.

Often, the pass element 216 has an inherent dropout voltage. In some aspects, the inherent dropout voltage is a minimum voltage to be maintained across the pass element 216, if the output voltage Vout 212 is to be regulated (i.e., to maintain the regulation of the output voltage). In some aspects, the inherent dropout voltage is contributed by a minimum inherent resistance of the pass element 216. In some aspects, the input voltage Vin 214 may vary due to various circuit conditions or environmental conditions. If the input voltage Vin 214 decreases to a level that is very near the regulated output voltage $V_{REG}$, the output voltage Vout 212 varies from the regulated output voltage $V_{REG}$ to maintain the inherent dropout voltage, thereby entering a dropout condition. During the dropout condition, because the output voltage Vout 212 varies from the regulated output voltage $V_{REG}$, the voltage regulation of the output voltage Vout 212 (by the voltage error amplifier circuit 218) is lost. If the output voltage Vout 212 is not regulated during the dropout condition, a large output voltage overshoot may occur when the input voltage Vin 214 returns high while exiting the dropout condition. Therefore, keeping the output voltage Vout 212 regulated is important during the dropout condition.

To maintain the output voltage regulation with the varying input voltage Vin 214 (specifically during the dropout condition), the linear regulator system 200 includes a dropout error amplifier circuit 224 and a dropout driver circuit 234. In some aspects, the dropout error amplifier circuit 224 and the dropout driver circuit 234 together form a dropout control circuit similar to the dropout control circuit 106 in FIG. 1. In some aspects, the dropout error amplifier circuit 224 is configured to regulate the output voltage Vout 212 of the pass element 216 to a dropout condition output voltage $V_{DO_OUT}$, which keeps the voltage across the pass element 216 equal to a target reference voltage Vdo_TG, based on negative feedback, when the input voltage Vin 214 is too low to maintain the regulated output voltage $V_{REG}$. In some aspects, the target dropout voltage Vdo_TG is a particular dropout voltage that is greater than the inherent dropout voltage of the pass element 216. In alternative implementations, the target dropout voltage Vdo_TG may be equal to the inherent dropout voltage of the pass element 216. In some aspects, the dropout error amplifier circuit 224 is configured to regulate the output voltage Vout 212 of the pass element 216 to the dropout condition output voltage $V_{DO_OUT}$, based on a dropout reference voltage Vdo_ref 238 that is derived in terms of the target dropout voltage Vdo_TG.

For example, the dropout error amplifier circuit 224 includes: a first input terminal 226 configured to receive the output voltage Vout 212; and a second input terminal 228 configured to receive a dropout reference voltage Vdo_ref 238 including a difference between the input voltage Vin 214 and the target dropout voltage Vdo_TG of the pass element 216. The dropout error amplifier circuit 224 includes an output terminal (or an error output terminal) 230 configured to provide a dropout control signal CNTRL 232, which is generated based on a comparison of the output voltage Vout 212 and the dropout reference voltage Vdo_ref 238. In some aspects, the dropout error amplifier circuit 224 is configured to regulate the output voltage Vout 212 of the pass element 216 to a dropout condition output voltage $V_{DO_OUT}$, based on the dropout control signal 232. In some aspects, the dropout condition output voltage $V_{DO_OUT}$ is equal to the dropout reference voltage Vdo_ref 238. In some aspects, the dropout control signal 232 regulates the output voltage Vout 212 of the pass element 216 to the dropout condition output voltage $V_{DO_OUT}$, based on modulating a resistance of the pass element 212.

The dropout control signal CNTRL 232 regulates the output voltage Vout 212 of the pass element 216 to the dropout condition output voltage $V_{DO_OUT}$, when the dropout reference voltage Vdo_ref 238 at the second input terminal 228 of the dropout error amplifier circuit 224 becomes less than the output voltage Vout 212 at the first input terminal 226 of the dropout error amplifier circuit 224, in order to operate the linear regulator core circuit 202 in a dropout operation mode in which the output voltage Vout 212 is maintained at the dropout condition output voltage $V_{DO_OUT}$. In some aspects, the dropout reference voltage Vdo_ref 238 at the second input terminal 228 of the dropout error amplifier circuit 224 becomes less than the output voltage Vout 212, when Vin 214 decreases to a level that is very near Vout 212, so the difference between Vin 214 and Vout 212 is less than the target dropout voltage Vdo_TG of the pass element 216. Therefore, in such aspects, Vout 212 is regulated by the dropout control signal 232 to form the dropout condition output voltage $V_{D_OUT}$, so the difference between the $V_{DO_OUT}$ and Vin 214 is kept equal to the target dropout voltage Vdo_TG. Accordingly, Vout 212 is regulated by the dropout control signal CNTRL 232 to form the dropout condition output voltage $V_{DO_OUT}$, so the output voltage Vout 212 (i.e., the dropout condition output voltage $V_{DO_OUT}$) at the first input terminal 226 of the dropout error amplifier circuit 224 becomes equal to the dropout reference voltage Vdo_ref 238 at the second input terminal 228 of the dropout error amplifier circuit 224. Therefore, the dropout condition output voltage $V_{DO_OUT}$ is equal to the dropout reference voltage Vdo_ref 238. In some aspects, the dropout condition output voltage $V_{DO_OUT}$ is less than the regulated output voltage $V_{REG}$.

In some aspects, the dropout control signal CNTRL 232 regulates the output voltage Vout 212 of the pass element 216 to the dropout condition output voltage $V_{DO_OUT}$ until the dropout reference voltage Vdo_ref 238 at the second input terminal 228 of the dropout error amplifier circuit 224 becomes greater than the regulated output voltage $V_{REG}$. In some aspects, the voltage error amplifier circuit 118 is configured to regulate the output voltage Vout 112 to the regulated output voltage $V_{REG}$, when the dropout reference voltage Vdo_ref 238 at the second input terminal 228 of the dropout error amplifier circuit 224 becomes equal to or greater than the regulated output voltage $V_{REG}$. For example, voltage error amplifier circuit 218 is configured to regulate the output voltage Vout 212 to the regulated output voltage $V_{REG}$, during a regular operation mode of the linear regulator circuit in which the Vin 214 is greater than $V_{REG}$ at least by the target dropout voltage Vdo_TG. Consequently, during the regular operation mode, the dropout reference voltage Vdo_ref 238 (i.e., the difference between the Vin 214 and the target dropout voltage Vdo_TG as defined above) at the second input terminal 228 of the dropout error amplifier circuit 224 is greater than or equal to the output voltage Vout 212 (comprising the regulated output voltage $V_{REG}$). Therefore, during the regular operation mode, the dropout control signal 232 does not regulate the output voltage Vout 212 of the pass element 216 to the dropout condition output voltage $V_{DO_OUT}$.

In some aspects, the output terminal 230 of the dropout error amplifier circuit 224 is coupled to the control terminal 239 of the pass element 216, in order to modulate the resistance of the pass element 216 (in turn to regulate the output voltage Vout 212 of the pass element 216). In some aspects, the dropout error amplifier circuit 224 is configured to modulate the resistance of the pass element 216 based on controlling a voltage at the gate terminal 239 of the PFET 216. In some aspects, the dropout error amplifier circuit 224 is coupled to the control terminal 239 of the pass element 216 via a dropout driver circuit including an NFET 234. In some aspects, the NFET 234 corresponds to the dropout driver circuit 134 in FIG. 1. In alternative implementations, the dropout driver circuit 234 may be implemented differently. In some aspects, the dropout error amplifier circuit 224 is configured to provide the dropout control signal 232 to a gate terminal 233 of the NFET 234, in order to regulate the output voltage Vout 212 of the pass element 216 to the dropout condition output voltage VDO_OUT. For example, the NFET 234 is configured to receive the dropout control signal 232 at its gate terminal 233, receive a supply voltage (e.g., Vdd) at its drain terminal, and provide a dropout driver signal 236 at its source terminal. However, the terminals may vary depending on the type of the power semiconductor switch. In some aspects, the drain terminal may correspond to a collector terminal, and the source terminal may correspond to an emitter terminal in case of BJT. In some aspects, the dropout driver signal 236 modulates the resistance of the pass element 216, in order to regulate the output voltage Vout 212 of the pass element 216 to the dropout condition output voltage $V_{DO_OUT}$. In some aspects, Vdd may be same as Vin 214, or Vdd can be an internally generated regulated derivative of Vin 214, which helps in achieving better supply rejection performance.

For example, the dropout control signal 232 modulates a resistance of the NFET 234 during the dropout operation mode, in order to generate the dropout driver signal 236 that overrides the voltage error signal 237 from the voltage error amplifier circuit 218, and in order to modulate the resistance of the pass element 216. Accordingly, during the dropout operation mode, the dropout driver signal 236 (generated based on the dropout control signal 232) is high enough to override the voltage error signal 237 from the voltage error amplifier circuit 218. Further, during the regular operation mode, the dropout driver signal 236 generated by the NFET 234 may be negligible or zero, thereby not overriding the voltage error signal 237 from the voltage error amplifier circuit 218. In alternative implementations, the dropout control signal 232 may control the control terminal 239 of the pass element 216 directly without using the dropout driver circuit 234. Therefore, in some aspects, the dropout error amplifier circuit 224 ensures that the output voltage 212 is regulated, when the output voltage 212 is reduced from the regulated output voltage $V_{REG}$ due to a reduction in the input voltage Vin 214.

In this aspect, the Vout 212 is provided to the positive terminal of the dropout error amplifier circuit 224, and the dropout reference voltage Vdo_ref 238 is provided to the negative terminal of the dropout error amplifier circuit 224, so as to generate a CNTRL 232 of VDD (i.e., a positive voltage), in order to turn ON (e.g., fully turn ON with minimum ON resistance) the NFET 234, when the dropout reference voltage Vdo_ref 238 falls below the Vout 212. Further, the CNTRL 234 modifies (i.e., increases) the resistance of the NFET 234 (e.g., to turn OFF the NFET 234), when the dropout reference voltage Vdo_ref 238 rises above the regulated output voltage $V_{REG}$ (e.g., during the regular operation mode), thereby providing negligible or zero dropout driver signal 236. However, in other aspects, the terminals may be inverted. For example, if the dropout driver circuit includes PFET 234 instead of the NFET 234, the Vout 212 may be provided to the negative terminal of the dropout error amplifier circuit 224, and the dropout reference voltage Vdo_ref 238 may be provided to the positive terminal of the dropout error amplifier circuit 224, in order to turn ON the PFET 234, when the dropout reference voltage Vdo_ref 238 falls below the Vout 212.

In linear regulators, the inherent dropout voltage may vary with the load current 217. Accordingly, when the load current 217 through the pass element 216 is lower, the inherent dropout voltage of the pass element 216 is lower. And when the load current 217 through the pass element 216 is higher, the inherent dropout voltage of the pass element 216 is higher. To account for the variation of the inherent dropout voltage with respect to the load current 217, in this aspect, the target dropout voltage Vdo_TG to be maintained across the pass element 216 is derived as a function of a load current 217 through the pass element 216. Accordingly, the target dropout voltage Vdo_TG is modulated/varied with a variation in the load current 217. In some aspects, varying the target dropout voltage Vdo_TG with the load current 217 enables a reduction in power consumption of the linear regulator core circuit 102 by maintaining a lower Vdo_TG across the pass element 216 during low load current conditions. To account for the variation of the Vdo_TG, the linear regulator system 200 includes a dropout reference voltage generator circuit 208 configured to generate the dropout reference voltage Vdo_ref 238 including a difference between the input voltage Vin 214 and the target dropout voltage Vdo_TG of the pass element 216.

For example, the dropout reference voltage generator circuit 208 includes a dropout resistance element Rdo 241 configured to have a voltage drop corresponding to the target dropout voltage Vdo_TG of the pass element 216 when a sense current 244 indicative of the load current 217 passes through the dropout resistance element Rdo 241. In some aspects, the sense current 244 includes a fraction of the load current 217. In some aspects, a value of the Rdo 241 is determined based on determining the target dropout voltage Vdo_TG of the pass element 216 for a maximum value of the load current 217 and identifying a selected resistance value that achieves a voltage drop corresponding to the target dropout voltage Vdo_TG, when a sense current 244 corresponding to the maximum load current 217 flows through the selected resistance value. The dropout resistance element Rdo 241 includes: a first terminal 245 coupled to the input voltage 214; and a second terminal 249 configured to provide the dropout reference voltage Vdo_ref 238 including a difference between the Vin 214 and the Vdo_TG.

Figure 2B:
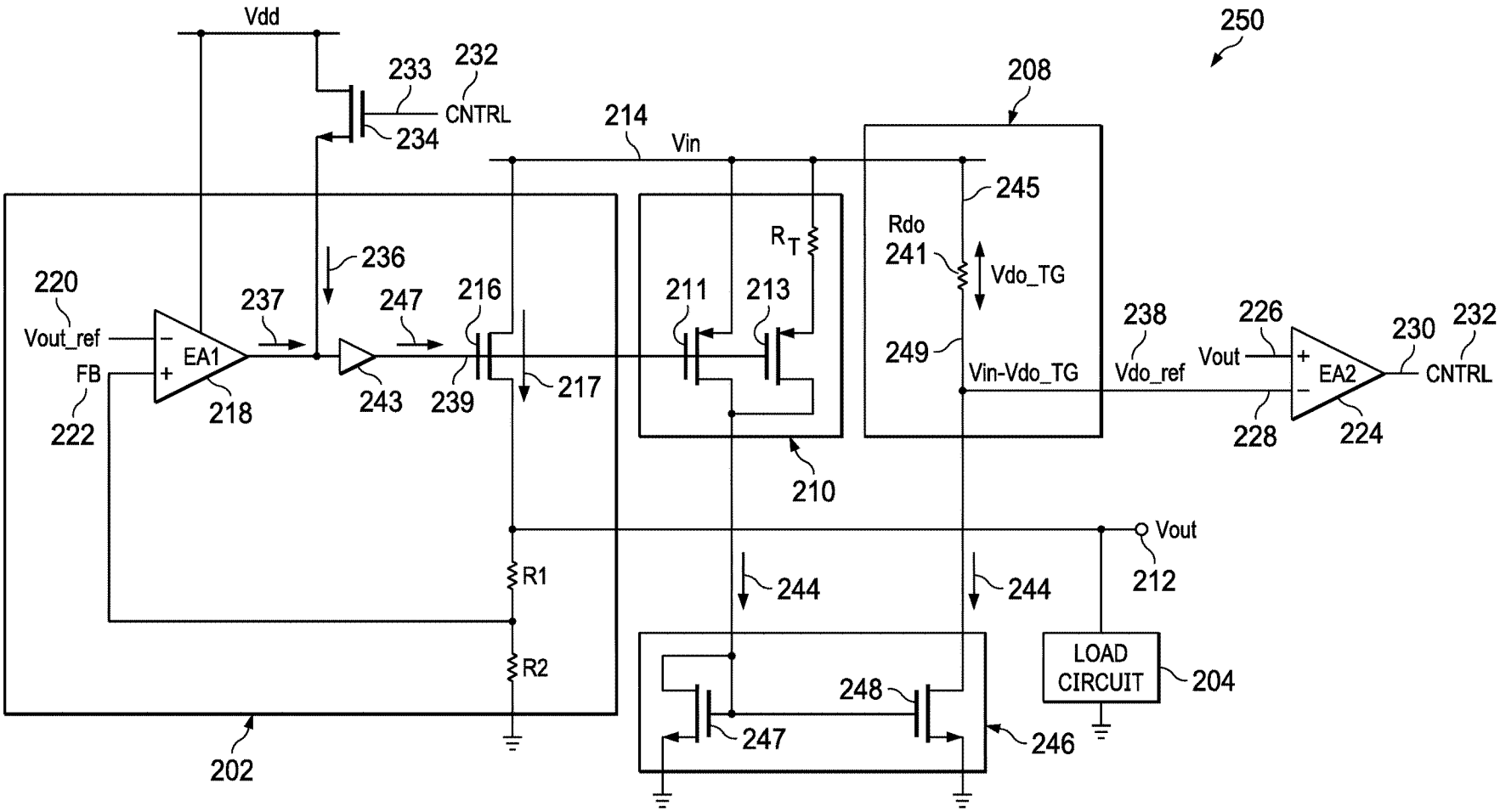
FIG. 2*b* illustrates another example implementation of a linear regulator system, according to one aspect of this description.

The linear regulator system 200 includes a load current sense circuit 210, which includes a sense switch element 211 coupled to the pass element 216 and configured to generate the sense current 244 indicative of the load current 217. In some aspects, the sense current 244 includes a fraction of the load current 217. In some aspects, the sense switch element 211 is selected to be smaller than the pass element 216, in order to generate the sense current 244. In some aspects, the inherent dropout voltage of the pass element 216 varies further with a temperature of the linear regulator system 200. Accordingly, when the temperature is lower, the inherent dropout voltage is lower. And when the temperature is higher, the inherent dropout voltage is higher. To account for the variation of the inherent dropout voltage with temperature, in this aspect, the target dropout voltage Vdo_TG to be maintained across the pass element 216 is further derived as a function of the temperature of the linear regulator system 200. To achieve this feature, the sense current 244 that flows through the dropout resistance element Rdo 241 is derived as a function of a temperature of the linear regulator system 200. In such aspects, the load current sense circuit 210 may include a sense switch element 211 and a temperature dependent switch element 213 coupled to the sense switch element 211, which are configured to generate the sense current 244 as shown in the linear regulator system 250 in FIG. 2*b*. In such aspects, the sense current 244 is derived as a function of a temperature of the linear regulator system 200. For example, in such embodiments, the temperature dependent switch element 213 is sized to be bigger than the sense switch element 211, and the temperature dependent switch element 213 includes a resistance element $R_T$ coupled in series therewith, in order to generate the sense current 244 that is derived as a function of a temperature of the linear regulator system 200. The sense current 244 in FIG. 2*b* is a combination of: a first sense current $Isense_1$ through the sense switch element 211; and a second sense current $Isense_2$ through the temperature dependent switch element 213. In some aspects, $I_{SENSE2}=\Delta V_{GS}/R_T$, where $\Delta V_{GS}=V_{GS1}-V_{GS2}$, where $V_{GS1}$ is the gate source voltage of the sense switch element 211, and $V_{GS2}$ is the gate source voltage of the temperature dependent switch element 213. Therefore, $$\Delta V_{GS} = \sqrt{\frac{2I_1}{\beta_1}} - \sqrt{\frac{2I_2}{\beta_2}}, \text{ where } \beta = \mu C_{ox}\frac{W}{L} \tag{1}$$

where $I_1=Isense_1$, $I_2=Isense_2$, μ is the mobility, $C_{ox}$ is the gate oxide capacitance of the MOSFET, W is the width of the MOSFET and L is the length of the MOSFET.

In some aspects, mobility decreases as a strong function of temperature T (μ is proportional to $T^{-2.2}$), so β decreases as a strong function of temperature. Thus, ΔVGS is set to fairly increase with temperature, which in turn increases $Isense_2$. Accordingly, $Isense=Isense_1+Isense_2$ increases with temperature. All other features of the linear regulator system 250 are similar to the linear regulator system 200 in FIG. 2*a* described above.

Also, in some aspects, the linear regulator system 200 includes a current mirror circuit 246 configured to mirror the sense current 244 from the load current sense circuit 210 and configured to provide the sense current 244 to the dropout reference voltage generator circuit 208. The current mirror circuit 246 includes a first NFET 247 and a second NFET 248 having their gate terminals coupled to one another. Further, the sense current 244 from the load current sense circuit 210 is coupled to a common node, which couples the gate terminals of the first NFET 247 and a second NFET 248, in order to mirror the sense current 244 to the drain terminal of the second NFET 248. Also, the drain terminal of the second NFET 248 is coupled to the dropout reference voltage generator circuit 208, in order to provide the sense current 244 to the dropout reference voltage generator circuit 208. Alternative implementations of the current mirror circuit 246 are also within the scope of this description. Further, in some aspects, the load current sense circuit 210 may be configured to provide the sense current 244 directly to the dropout reference voltage generator circuit 208 without using the current mirror circuit 246.

Figure 2C:
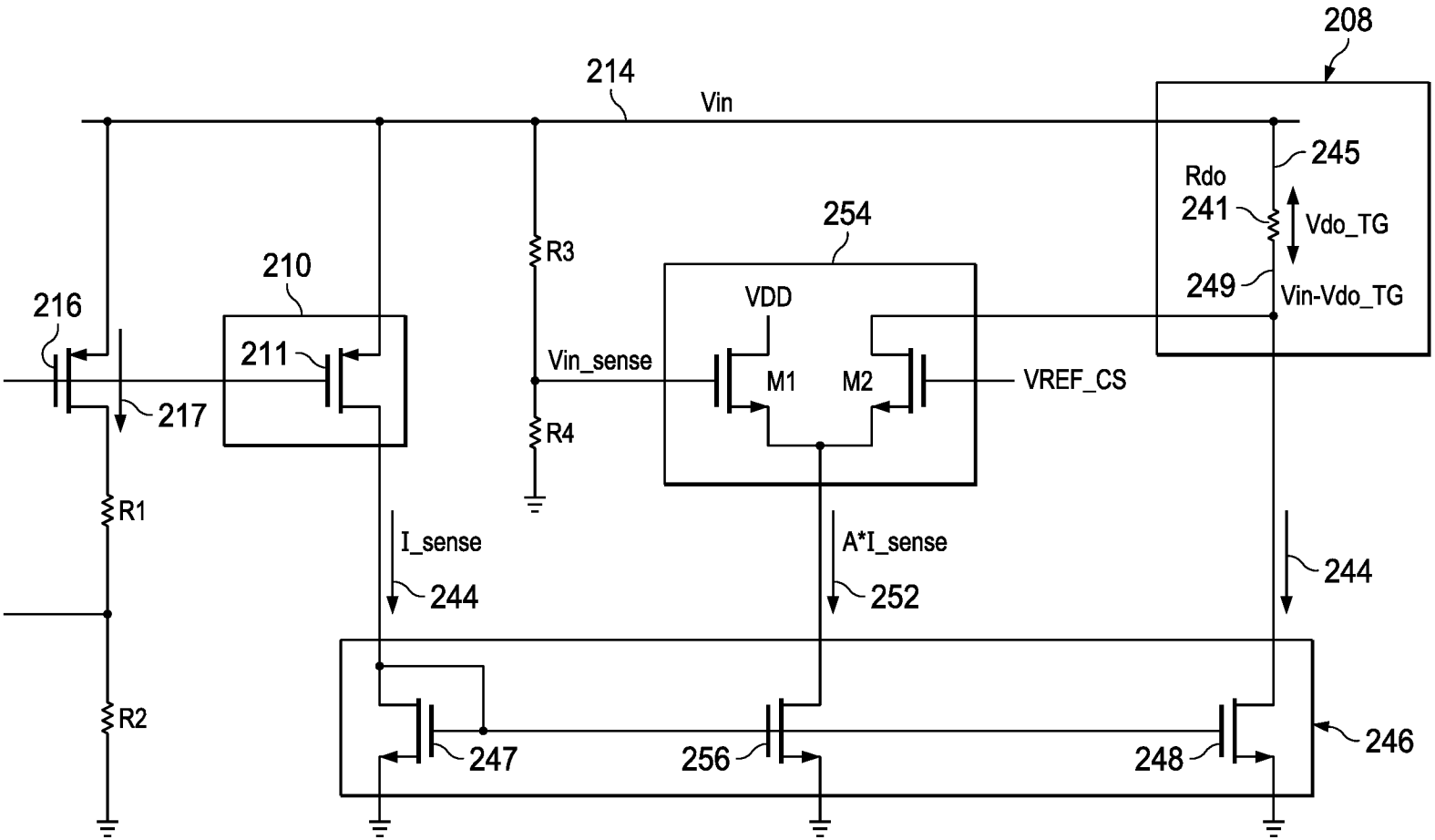
FIG. 2*c* illustrates an example implementation of a current steering circuit of a linear regulator system, according to one aspect of this description.

In some aspects, for a given load current, when the Vin 214 falls below a particular supply voltage threshold, a gate source voltage ($V_{GS}$) of the pass element 216 decreases. In such aspects, the inherent dropout voltage of the pass element 216 increases. To account for the variation of the inherent dropout voltage with the Vin 214, in this aspect, the target dropout voltage Vdo_TG to be maintained across the pass element 216 is increased when the Vin 214 becomes less than the particular supply voltage threshold. To achieve this feature, the linear regulator system 200 includes a current steering circuit 254 coupled between the load current sense circuit 210 and the dropout reference voltage generator circuit 208, as shown in FIG. 2*c*. For example, the current steering circuit 254 includes a first switch element M1 configured to receive (at its gate terminal) an input sense voltage Vin_sense indicative of Vin 214. In some aspects, input sense voltage Vin_sense includes a fraction of the Vin 214. Further, the current steering circuit 254 includes a second switch element M2 configured to receive (at its gate terminal) a current steering threshold voltage $V_{REF_CS}$ indicative of the particular supply voltage threshold. A drain terminal of the first switch element M1 is coupled to VDD, and a drain terminal of the second switch element M2 is coupled to the dropout reference voltage generator circuit 208.

Further, the first switch element M1 and the second switch element M2 are coupled to the current mirror circuit 246 via a current steering switch element 256, thereby enabling a steering current A*Isense 252 to flow through the current steering circuit 254. In some aspects, the steering current A*Isense 252 is a fraction or a multiple of the sense current 244. In some aspects, the value of the steering current A*Isense 252 is defined by the size of the current steering switch element 256. When Vin_sense>$V_{REF_CS}$, all the steering current A*Isense 252 flows through M1. When Vin_sense decreases and becomes near $V_{REF_CS}$, a part of the steering current A*Isense 252 flows through M2. When Vin_sense=$V_{REF_CS}$, half of the steering current A*Isense 252 flows through each of M1 and M2. When Vin_sense<$V_{REF_CS}$, all of the steering current A*Isense 252 flows through M2. A current through M2 flows through Rdo 241, thereby increasing the target dropout voltage Vdo_TG.

Figure 3:
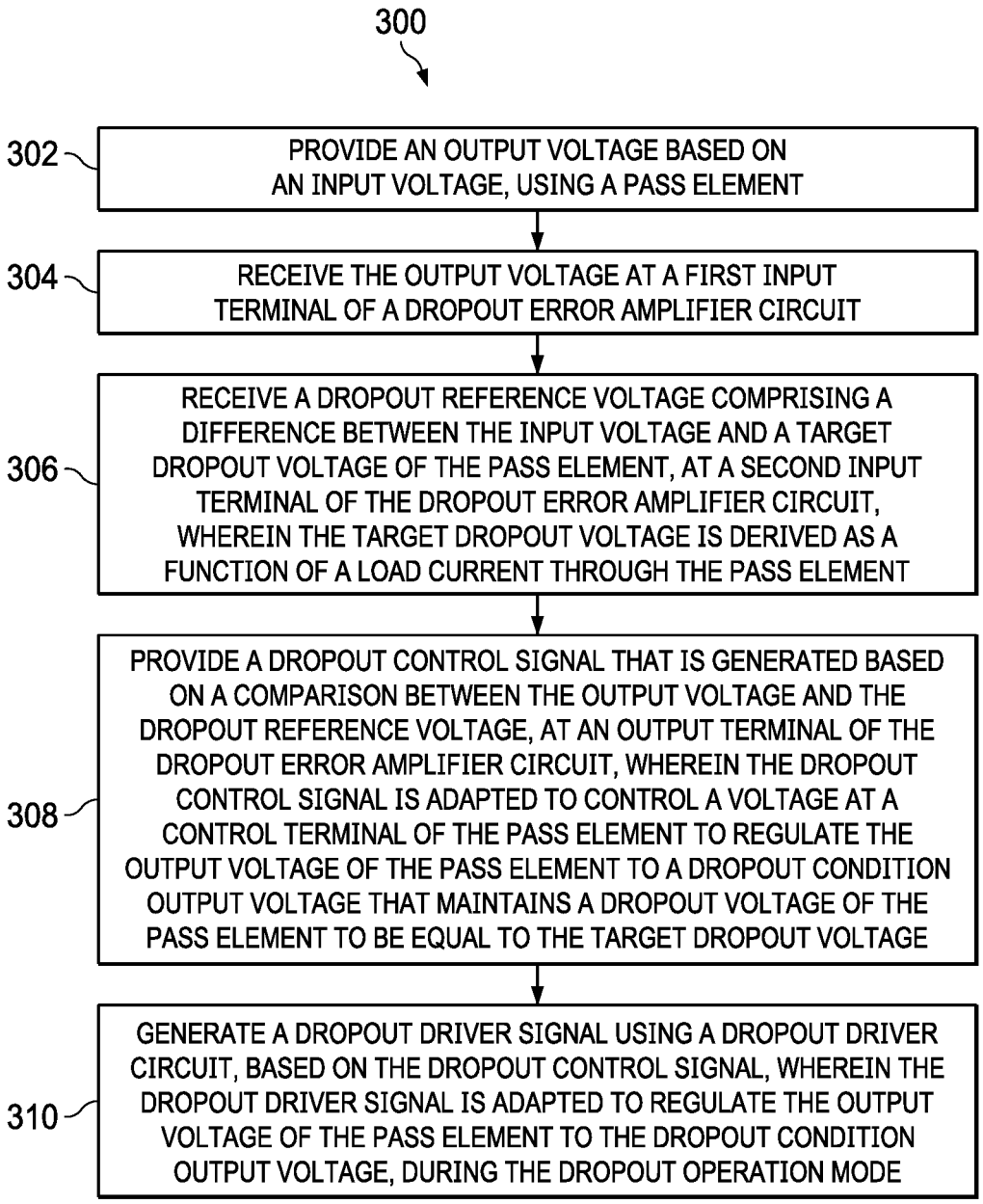
FIG. 3 is a flowchart of an example method for a linear regulator system, according to one aspect of this description.

FIG. 3 is a flowchart of an example method 300 for a linear regulator system, according to one aspect of this description. The method 300 may be implemented within the linear regulator system 100 in FIG. 1 and is therefore described herein with reference to the linear regulator system 100 in FIG. 1. However, the method 300 is equally applicable to the linear regulator system 200 in FIG. 2*a* and the linear regulator system 250 in FIG. 2*b*. At 302, an output voltage (e.g., the Vout 112) of a linear regulator core circuit (e.g., the linear regulator core circuit 102 in FIG. 1) is provided, using a pass element (e.g., the pass element 116), based on an input voltage (e.g., the input voltage Vin 114). At 304, the output voltage is received at a first input terminal (e.g., the first input terminal 126 in FIG. 1) of a dropout error amplifier circuit (e.g., the dropout error amplifier circuit 124 in FIG. 1). At 306, a dropout reference voltage (e.g., the dropout reference voltage 138 in FIG. 1) including a difference between the input voltage and a target dropout voltage of the pass element is received at a second input terminal (e.g., the second input terminal 128 of FIG. 1) of the dropout error amplifier circuit. The target dropout voltage is derived as a function of a load current (e.g., the load current 117 in FIG. 1) through the pass element. In some aspects, the target dropout voltage is further derived as a function of a temperature of the linear regulator system. Also, in some aspects, the target dropout voltage is derived to ensure that the target dropout voltage increases when the input voltage falls below a particular supply voltage threshold.

At 308, a dropout control signal (e.g., the dropout control signal 132 in FIG. 1) generated based on a comparison of the output voltage and the dropout reference voltage is provided at an output terminal (e.g., the output terminal 130 in FIG. 1) of the dropout error amplifier circuit. In some aspects, the dropout control signal regulates the output voltage of the pass element to a dropout condition output voltage $V_{DO_OUT}$ that keeps a voltage across the pass element equal to the target dropout voltage. In some aspects, the dropout control signal regulates the output voltage of the pass element to the dropout condition output voltage $V_{DO_OUT}$ based on modulating a resistance of the pass element. In some aspects, the dropout control signal regulates the output voltage of the pass element to the dropout condition output voltage $V_{DO_OUT}$, when the dropout reference voltage at the second input terminal of the dropout error amplifier circuit becomes less than the output voltage at the first input terminal of the dropout error amplifier circuit, in order to operate the linear regulator core circuit in a dropout operation mode in which the output voltage is maintained at the dropout condition output voltage. At 310, a dropout driver signal (e.g., the dropout driver signal 136 in FIG. 1) is generated based on the dropout control signal, using a dropout driver circuit (e.g., the dropout driver circuit 134 in FIG. 1). In some aspects, the dropout driver signal modulates the resistance of the pass element, during the dropout operation mode of the linear regulator circuit, in order to regulate the output voltage of the pass element to the dropout condition output voltage $V_{DO_OUT}$.

The methods are illustrated and described above as a series of acts or events, but the illustrated ordering of such acts or events is not limiting. For example, some acts or events may occur in different orders and/or concurrently with other acts or events apart from those illustrated and/or described herein. Also, some illustrated acts or events are optional to implement one or more aspects or embodiments of this description. Further, one or more of the acts or events depicted herein may be performed in one or more separate acts and/or phases. In some embodiments, the methods described above may be implemented in a computer readable medium using instructions stored in a memory.

In this description, the term "couple" may cover connections, communications or signal paths that enable a functional relationship consistent with this description. Accordingly, if device A generates a signal to control device B to perform an action, then: (a) in a first example, device A is coupled directly to device B; or (b) in a second example, device A is coupled to device B through intervening component C if intervening component C does not substantially alter the functional relationship between device A and device B, so device B is controlled by device A via the control signal generated by device A.

Modifications are possible in the described examples, and other implementations are possible, within the scope of the claims.

What is claimed is:

1. An apparatus, comprising:

a first transistor having a first control terminal and first and second current terminals;

a second transistor having a second control terminal and third and fourth current terminals, the third current terminal coupled to the first current terminal, and the second control terminal coupled to the first control terminal;

a reference voltage generator having a reference terminal coupled to the fourth current terminal, the reference voltage generator configured to provide a dropout reference voltage at the reference terminal responsive to a current in the second transistor;

a first amplifier having a first amplifier output, a first feedback input, and a first reference input, the first amplifier output coupled to the first control terminal; and a second amplifier having a second amplifier output, a second feedback input, and a second reference input, the second feedback input coupled to the second current terminal, the second reference input coupled to the reference terminal, and the second amplifier output coupled to the first control terminal.

2. The apparatus of claim 1, wherein:

the reference voltage generator is configured to provide the dropout reference voltage at the first reference input;

the first amplifier is configured to provide a first control signal at the first amplifier output responsive to a difference between a reference output voltage at the first reference input and a feedback voltage at the first feedback input; and the second amplifier is configured to provide a second control signal that overrides the first control signal responsive to a state of the second amplifier output indicating that the dropout reference voltage is below a voltage at the second current terminal.

3. The apparatus of claim 2, further comprising a divider circuit having a divider input and a divider output, the first feedback input is coupled to the divider output, and the second current terminal is coupled to the divider input; and wherein the divider circuit is configured to provide the feedback voltage at the divider output responsive to the voltage at the second current terminal.

4. The apparatus of claim 3, wherein:

the current is a first current the voltage is a first voltage;

the first transistor is configured to provide the first voltage responsive to a second voltage at the first current terminal and the first or second control signals, and to conduct a second current responsive to the first or second control signals;

the second transistor is configured to provide the first current at the fourth current terminal, in which the first current represents the second current; and the reference voltage generator has an input coupled to the first current terminal and configured to generate the dropout reference voltage responsive to the first current and the second voltage.

5. The apparatus of claim 1, further comprising a driver circuit having an input and an output, the input of the driver circuit coupled to the second amplifier output, and the output of the driver circuit coupled to the first control terminal.

6. The apparatus of claim 5, wherein the driver circuit includes a semiconductor switch having fifth and sixth current terminals and a third control terminal, the fifth current terminal coupled to a supply terminal, the sixth current terminal coupled to the first control terminal, and the third control terminal coupled to the second amplifier output.

7. The apparatus of claim 1, further comprising a current mirror having a current input and a current output, the current input coupled to the fourth current terminal, and the current output coupled to the reference terminal.

8. The apparatus of claim 7, wherein the reference voltage generator includes a resistor coupled between the first current terminal and the reference terminal.

9. The apparatus of claim 7, further comprising a third transistor having fifth and sixth current terminals and a third control terminal, the fifth current terminal coupled to the first current terminal, the sixth current terminal coupled to the reference terminal, and the third control terminal coupled to the first and second control terminals.

10. The apparatus of claim 9, wherein the current is a first current, and the third transistor is configured to provide a second current at the sixth current terminal responsive to a temperature of the apparatus.

11. The apparatus of claim 10, further comprising a resistor coupled between the first current terminal and the fifth current terminal, in which the second current increases with the temperature .

12. The apparatus of claim 4, wherein the reference voltage generator is configured to increase the dropout reference voltage responsive to a voltage at the first current terminal falling below a voltage threshold.

13. The apparatus of claim 12, further comprising a current steering circuit coupled to the reference voltage generator, the current steering circuit configured to reduce the second current received by the reference voltage generator in response to the voltage at the first current terminal falling below the voltage threshold.

14. An apparatus, comprising:

a transistor having a control terminal and first and second current terminals;

a current sense circuit having a current sense input and a current sense output, the current sense input coupled to the control terminal;

a reference voltage generator having a reference terminal coupled to the current sense output;

a first amplifier having a first amplifier output, a first feedback input, and a first reference input the first amplifier output coupled to the control terminal; and a second amplifier having a second amplifier output, a second feedback input, and a second reference input, the second feedback input coupled to the second current terminal, the second reference input coupled to the reference terminal, and the second amplifier output coupled to the control terminal.

15. The apparatus of claim 14, wherein:

the reference voltage generator is configured to provide a dropout reference voltage at the reference terminal;

the first amplifier is configured to provide a control signal at the first amplifier output responsive to a difference between a reference output voltage at the first reference input and a feedback voltage at the first feedback input; and the second amplifier is configured to override the control signal provided by the first amplifier responsive to a state of the second amplifier output indicating that the dropout reference voltage is below a voltage at the second current terminal.

16. The apparatus of claim 15, further comprising a divider circuit having a divider input and a divider output, wherein:

the first feedback input is coupled to the divider output;

the second current terminal is coupled to the divider input; and the divider circuit is configured to provide the feedback voltage responsive to a voltage at the second current terminal.

17. The apparatus of claim 16, wherein:

the voltage is a first voltage;

the transistor is a first transistor;

the control terminal is a first control terminal;

the first transistor is configured to provide the first voltage responsive to a second voltage at the first current terminal and the control signal, and to conduct a first current responsive to the control signal;

the current sense circuit includes a second transistor having third and fourth current terminals and a second control terminal, the second control terminal coupled to the current sense input, the third current terminal coupled to the first current terminal, and the fourth current terminal coupled to the current sense output, the second transistor configured to provide a second current at the fourth current terminal, in which the second current represents the first current; and the reference voltage generator has an input coupled to the first current terminal and configured to generate the dropout reference voltage responsive to the second current and the second voltage.

18. The apparatus of claim 17, wherein the reference voltage generator includes a resistor coupled between the first current terminal and the reference terminal.

19. The apparatus of claim 18, wherein the resistor is a first resistor, and the current sense circuit includes:

a third transistor having fifth and sixth current terminals and a third control terminal, the sixth current terminal coupled to the current sense output, and the third control terminal coupled to the current sense input; and a second resistor coupled between the first current terminal and the fifth current terminal.

20. The apparatus of claim 17, further comprising a current steering circuit coupled to the reference voltage generator, the current steering circuit configured to adjust the second current received by the reference voltage generator in response to the second voltage at the first current terminal.

21. An apparatus, comprising:

a first transistor having a first control terminal and first and second current terminals;

a second transistor having a second control terminal and third and fourth current terminals, the third current terminal coupled to the first current terminal, and the second control terminal coupled to the first control terminal;

a reference voltage generator having a reference terminal coupled to the fourth current terminal, the reference voltage generator configured to provide a dropout reference voltage at the reference terminal responsive to a current in the second transistor;

a first amplifier having a first amplifier output, a first feedback input, and a first reference input, the first amplifier output coupled to the first control terminal;

a second amplifier having a second amplifier output, a second feedback input, and a second reference input, the second feedback input coupled to the second current terminal, the second reference input coupled to the reference terminal, and the second amplifier output coupled to the first control terminal; and a driver circuit having an input and an output, the input of the driver circuit coupled to the second amplifier output, and the output of the driver circuit coupled to the first control terminal.

22. An apparatus, comprising:

a first transistor having a first control terminal and first and second current terminals;

a second transistor having a second control terminal and third and fourth current terminals, the third current terminal coupled to the first current terminal, and the second control terminal coupled to the first control terminal;

a reference voltage generator having a reference terminal coupled to the fourth current terminal, the reference voltage generator configured to provide a dropout reference voltage at the reference terminal responsive to a current in the second transistor;

a current mirror having a current input and a current output, the current input coupled to the fourth current terminal, and the current output coupled to the reference terminal;

a first amplifier having a first amplifier output, a first feedback input, and a first reference input, the first amplifier output coupled to the first control terminal;

a second amplifier having a second amplifier output, a second feedback input, and a second reference input, the second feedback input coupled to the second current terminal, the second reference input coupled to the reference terminal, and the second amplifier output coupled to the first control terminal; and a driver circuit having an input and an output, the input of the driver circuit coupled to the second amplifier output, and the output of the driver circuit coupled to the first control terminal.

23. An apparatus, comprising:

a transistor having a control terminal and first and second current terminals;

a current sense circuit having a current sense input and a current sense output, the current sense input coupled to the control terminal;

a reference voltage generator having a reference terminal coupled to the current sense output;

a first amplifier having a first amplifier output, a first feedback input, and a first reference input, the first amplifier output coupled to the control terminal;

a second amplifier having a second amplifier output, a second feedback input, and a second reference input, the second feedback input coupled to the second current terminal, the second reference input coupled to the reference terminal, and the second amplifier output coupled to the control terminal; and a divider circuit having a divider input and a divider output, the divider input coupled to the second current terminal, and the divider output coupled to the first feedback input.

* * * * *